US012144415B2

(12) United States Patent
Hachisuka

(10) Patent No.: US 12,144,415 B2
(45) Date of Patent: Nov. 19, 2024

(54) TOOTHBRUSH

(71) Applicant: Lion Corporation, Tokyo (JP)

(72) Inventor: Ryosuke Hachisuka, Tokyo (JP)

(73) Assignee: Lion Corporation, Tokyo (JP)

( * ) Notice: Subject to any disclaimer, the term of this patent is extended or adjusted under 35 U.S.C. 154(b) by 608 days.

(21) Appl. No.: 17/417,023

(22) PCT Filed: Dec. 26, 2019

(86) PCT No.: PCT/JP2019/051085
§ 371 (c)(1),
(2) Date: Jun. 21, 2021

(87) PCT Pub. No.: WO2020/138270
PCT Pub. Date: Jul. 2, 2020

(65) Prior Publication Data

US 2022/0047064 A1 Feb. 17, 2022

(30) Foreign Application Priority Data

Dec. 27, 2018 (JP) ..... 2018-246149

(51) Int. Cl.
*A46B 5/00* (2006.01)
*A46B 5/02* (2006.01)
*A46B 9/04* (2006.01)

(52) U.S. Cl.
CPC ..... *A46B 5/0066* (2013.01); *A46B 5/007* (2013.01); *A46B 5/02* (2013.01); *A46B 9/04* (2013.01); *A46B 2200/1066* (2013.01)

(58) Field of Classification Search
CPC ..... A46B 5/0066; A46B 5/02; A46B 5/002; A46B 5/0054; A46B 5/0058;
(Continued)

(56) References Cited

U.S. PATENT DOCUMENTS 4,829,621 A * 5/1989 Phenegar ..... A46B 5/0079 15/167.1
5,054,154 A 10/1991 Schiffer et al.
(Continued)

FOREIGN PATENT DOCUMENTS

CN 102355834 B 3/2015
JP 6504937 A 6/1994
(Continued)

OTHER PUBLICATIONS

WO-2016204224 Machine Tranlsation (Year: 2016).*
(Continued)

*Primary Examiner* — Laura C Guidotti
*Assistant Examiner* — Alberto Saenz
(74) *Attorney, Agent, or Firm* — Kolisch Hartwell, P.C.

(57) ABSTRACT

A toothbrush includes an anisotropic deformation portion (70) on a rear end side from the bristle tufting surface (11), and a bending strength in a first direction orthogonal to the bristle tufting surface that is smaller than a bending strength in a second direction orthogonal to the long axis direction and the first direction. The anisotropic deformation portion includes an elastic deformation portion (90) that connects a first region on the tip end side from the anisotropic deformation portion and a second region on the rear end side from the anisotropic deformation portion. The elastic deformation portion is elastically deformable in the first direction and the second direction, and bending load when the head portion is displaced in the first direction is lower than a bending load when the head portion is displaced in the second direction.

13 Claims, 5 Drawing Sheets

(58) Field of Classification Search
CPC ..... A46B 5/0062; A46B 5/007; A46B 9/04; A46B 2200/1066
USPC ..... 15/143.1, 167.1
See application file for complete search history.

(56) References Cited

U.S. PATENT DOCUMENTS

| | | | | |
|---|---|---|---|---|
| 5,146,645 | A | 9/1992 | Dirksing | |
| 2014/0020198 | A1* | 1/2014 | Slocum | A46B 15/004 15/167.1 |

FOREIGN PATENT DOCUMENTS

| | | | | |
|---|---|---|---|---|
| JP | 3040913 | U | 9/1997 | |
| JP | 2001299451 | A | 10/2001 | |
| JP | 2003265233 | A | 9/2003 | |
| WO | WO-0121035 | A1 * | 3/2001 | A46B 15/0002 |
| WO | WO-2016204224 | A1 * | 12/2016 | A46B 5/00 |
| WO | 2017051777 | A1 | 3/2017 | |
| WO | 2018110299 | A1 | 6/2018 | |

OTHER PUBLICATIONS

Japanese Patent Office, "International Search Report" in connection with related International Application No. PCT/JP2019/051085, dated Mar. 3, 2020, 4 pgs.
Taiwan Intellectual Property Office, "Office Action," in connection with related Taiwanese Invention Patent Application No. 108147905, dated Sep. 7, 2023, 27 pages.
European Patent Office, "Extended European Search Report" in connection with related European Patent App. No. 19903275.6, dated Aug. 5, 2022, 7 pgs.
State Intellectual Property Office of the People's Republic of China, "Search Report" in connection with related Chinese Patent Application No. 2019800845615, dated Mar. 18, 2022, 8 pgs.
China National Intellectual Property Administration, "Notice of Proceeding with Registration Formalities" and "Notice of Granting a Patent Right for Invention" in connection with related Chinese Patent Application No. 201980084561.5, Aug. 10, 2023, 8 pages.

* cited by examiner

TOOTHBRUSH

TECHNICAL FIELD

The present invention relates to a toothbrush.

Priority is claimed on Japanese Patent Application No. 2018-246149 filed on Dec. 27, 2018, the content of which is incorporated herein by reference.

BACKGROUND ART

While the proportion of people at the age of 80 who have 20 teeth is approximately 50%, the proportion of elderly caries (root surface caries) has increased. Root caries is caries of dentin exposed due to gingival recession, and since dentin has a higher composition ratio of organic components than enamel, caries progresses faster. One example of a cause of gingival recession is over-brushing, in which brushing is performed at a brushing pressure (sweeping pressure) larger than that of an appropriate value.

As a countermeasure against the above over-brushing, a toothbrush that suppresses excessive brushing pressure by forming a neck portion made mainly of a soft resin is known, and since the neck portion has flexibility in all directions, it is difficult to stably apply a brush portion to a target portion during brushing.

On the other hand, in Patent Document 1, a technique focusing on anisotropy is disclosed in which the neck portion is not easily deformed in a front and rear direction (a direction orthogonal to a bristle tufting surface), and the neck portion is easily deformed in a side surface direction (a width direction parallel to a bristle tufting surface) when a load is applied to a tip end of the head portion by utilizing a soft resin. The toothbrush described in Patent Document 1 has a configuration in which an excessive increase in sweeping pressure can be efficiently controlled by providing flexibility with anisotropy to the neck portion.

CITATION LIST

Patent Document

Patent Document 1
PCT International Publication No. WO 2017/051777

SUMMARY OF INVENTION

Technical Problem

However, in the toothbrush described in Patent Document 1, since the main part of the toothbrush is made of a soft resin and is easily bent, during brushing in which the head is moved in various directions, it is difficult to maintain an appropriate brushing pressure and to accurately brush the dentition tooth by tooth at target portions.

The present invention has been made in consideration of the above points, and an object thereof is to provide a toothbrush able to accurately brush the dentition tooth by tooth while maintaining an appropriate brushing pressure.

Solution to Problem

According to a first aspect of the present invention, there is provided a toothbrush including a head portion provided on a tip end side in a long axis direction and having a bristle tufting surface; a grip portion disposed on a rear end side from the head portion; a neck portion disposed between the bristle tufting surface and the grip portion; and an anisotropic deformation portion provided on a rear end side from the bristle tufting surface, in which a bending strength in a first direction orthogonal to the bristle tufting surface is smaller than a bending strength in a second direction orthogonal to the long axis direction and the first direction, in which the anisotropic deformation portion includes an elastic deformation portion that connects a first region on the tip end side from the anisotropic deformation portion and is elastically deformable in the first direction and the second direction, and any bending load when the head portion is displaced in the first direction with a reference displacement amount of 10 mm, 20 mm, or 30 mm in a state where the grip portion is supported is lower than a bending load when the head portion is displaced in the second direction with a reference displacement amount of 10 mm in a state where the grip portion is supported.

In addition, in the toothbrush according to one aspect of the present invention, a difference between the bending load when the head portion is displaced in the first direction with the reference displacement amount in a state where the grip portion is supported, and the bending load when the head portion is displaced in the second direction with the reference displacement amount is 5.0 N or more in all of the reference displacement amounts of 10 mm, 20 mm, and 30 mm in a state where the grip portion is supported.

In addition, in the toothbrush according to one aspect of the present invention, a ratio of the bending load when the head portion is displaced in the second direction with the reference displacement amount in a state where the grip portion is supported to the bending load when the head portion is displaced in the first direction with the reference displacement amount in a state where the grip portion is supported is 5.0 or more in all of the reference displacement amounts of 10 mm, 20 mm, and 30 mm.

In addition, in the toothbrush according to one aspect of the present invention, any difference between the bending load when the head portion is displaced in the first direction with the reference displacement amount of 10 mm or 20 mm in a state where the grip portion is supported, and the bending load when the head portion is displaced in the second direction with the reference displacement amount of 10 mm is 4.0 N or more in a state where the grip portion is supported.

In addition, in the toothbrush according to one aspect of the present invention, any ratio of the bending load when the head portion is displaced in the second direction with the reference displacement amount of 10 mm in a state where the grip portion is supported to the bending load when the head portion is displaced in the first direction with the reference displacement amount of 10 mm or 20 mm in a state where the grip portion is supported is 2.0 or more.

In addition, in the toothbrush according to one aspect of the present invention, the bending load when the head portion is displaced in the second direction with the reference displacement amount is 5.0 N or more in all of the reference displacement amounts of 10 mm, 20 mm, and 30 mm, and the bending load when the head portion is displaced in the first direction with the reference displacement amount is 3.0 N or less in all of the reference displacement amounts of 10 mm, 20 mm, and 30 mm.

In addition, in the toothbrush according to one aspect of the present invention, the elastic deformation portion includes a first hard portion made of a hard resin and connecting the first region and the second region, and a soft portion made of a soft resin and covering a periphery of the hard portion.

In addition, in the toothbrush according to one aspect of the present invention, the anisotropic deformation portion includes a recessed portion that is open on at least one of a surface on one side and a surface on the other side in the first direction, and provided side by side with the elastic deformation portion in the second direction, or a closed cavity extending in the long axis direction inside the elastic deformation portion.

In addition, in the toothbrush according to one aspect of the present invention, the elastic deformation portions are provided on both sides in the second direction with the recessed portion interposed therebetween.

In addition, in the toothbrush according to one aspect of the present invention, the recessed portion includes a through-hole that penetrates the anisotropic deformation portion in the first direction.

In addition, in the toothbrush according to one aspect of the present invention, in a cross section orthogonal to the long axis direction of the anisotropic deformation portion, an occupancy rate of a cross-sectional area of a space of the cavity or the recessed portion to a maximum area of the anisotropic deformation portion is 20% or more and 60% or less.

In addition, in the toothbrush according to one aspect of the present invention, the elastic deformation portion includes a first hard portion made of a hard resin and connecting the first region and the second region, and a soft portion made of a soft resin and covering a periphery of the hard portion, a second hard portion is provided that is disposed in the cavity or the recessed portion, connects the first region and the second region, and is made of the hard resin, at least a portion of the second hard portion overlaps with the first hard portion in the second direction, and a bending strength of the second hard portion in the first direction is smaller than a bending strength of the second hard portion in the second direction.

In addition, in the toothbrush according to one aspect of the present invention, the second hard portion is disposed with a gap from the elastic deformation portion, and snaps and buckles when an external force exceeding a threshold value is applied to the head portion toward a back side which is a side opposite to the bristle tufting surface in the first direction.

In addition, in the toothbrush according to one aspect of the present invention, the second hard portion has a protrusion shape toward the back side when the external force in the first direction is equal to or less than the threshold value, and is reversed in a protrusion shape toward the bristle tufting surface side when the external force in the first direction exceeds the threshold value, and an apex of the protrusion shape is located in the recessed portion both when the external force is equal to or less than the threshold value and when the external force exceeds the threshold value.

In addition, in the toothbrush according to one aspect of the present invention, the second hard portion includes a groove portion extending in the second direction on at least one of the bristle tufting surface side and the back side in a region including an apex of the protrusion shape.

In addition, in the toothbrush according to one aspect of the present invention, a length of the anisotropic deformation portion in the long axis direction is 15 mm or more and 30 mm or less.

Advantageous Effects of Invention

According to the present invention, the toothbrush able to accurately brush the dentition tooth by tooth while maintaining the appropriate brushing pressure can be provided.

DESCRIPTION OF EMBODIMENTS

Hereinafter, embodiments of a toothbrush of the present invention will be described with reference to FIGS. 1 to 7.

The following embodiments illustrate one aspect of the present invention, do not limit the present invention, and can be randomly changed within the scope of the technical idea of the present invention. In addition, in the following drawings, in order to make each configuration easy to understand, the scale and number of each structure are different from those of the actual structure.

Figure 1:
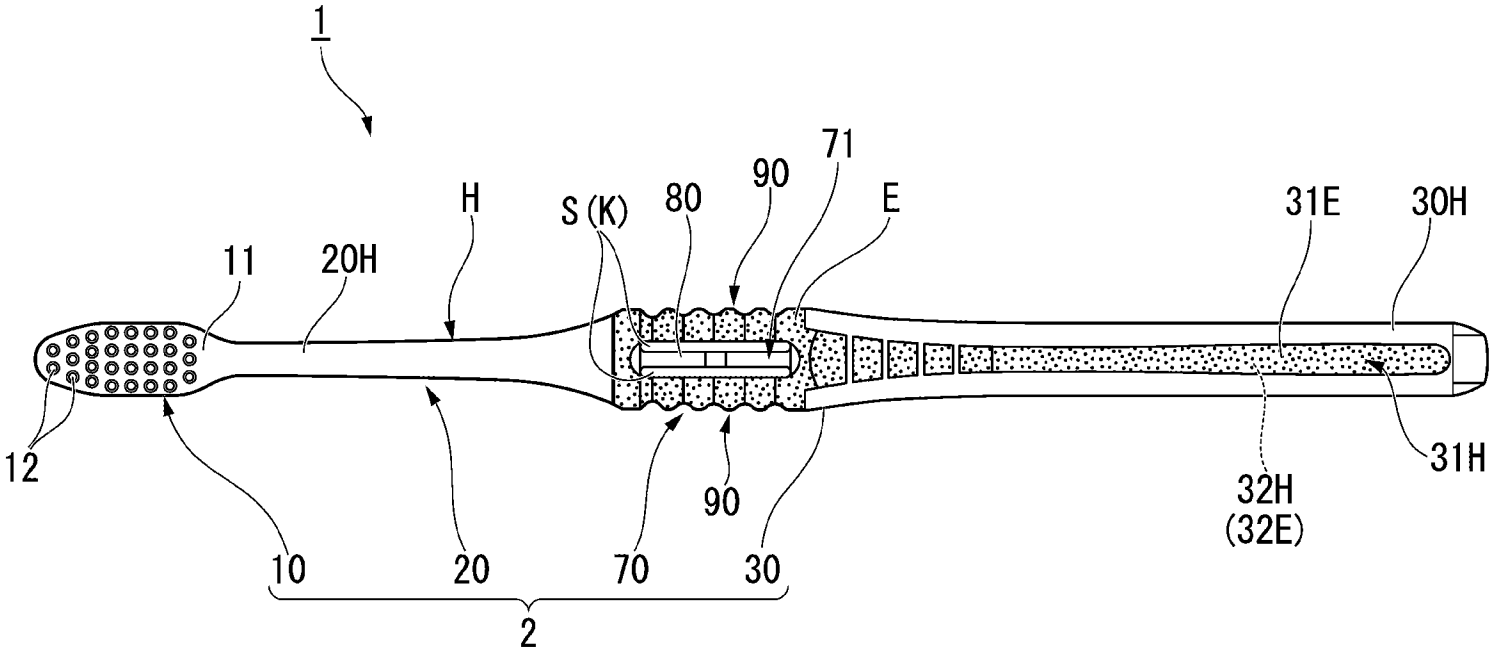
FIG. 1 is a view illustrating an embodiment of the present invention and is a front view of a toothbrush 1.
Figure 2:
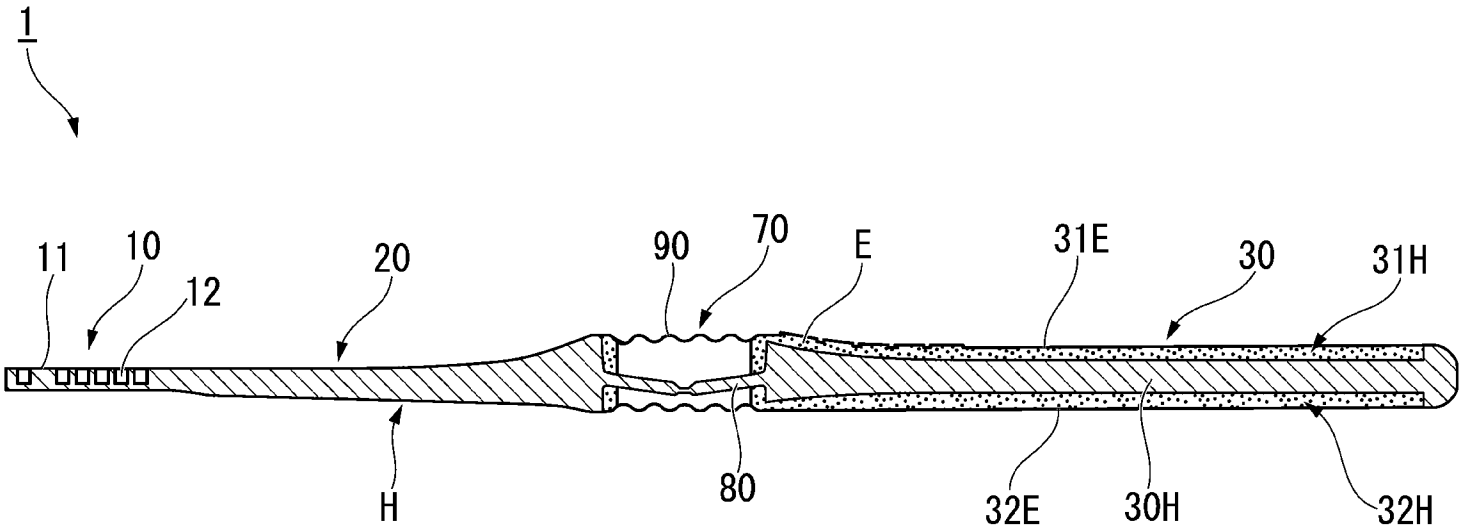
FIG. 2 is a cross-sectional view of the toothbrush 1 along a plane including a center in a width direction.

FIG. 1 is a front view of a toothbrush 1. FIG. 2 is a cross-sectional view of the toothbrush 1 along a plane including a center in a width direction (vertical direction in FIG. 1).

The toothbrush 1 of the present embodiment is provided with a head portion 10 disposed on a tip end side in the long axis direction (hereinafter, simply referred to as a tip end side) and on which a bristle bundle (not illustrated) of bristles is tufted, a neck portion 20 extending on a rear end side (hereinafter, simply referred to as a rear end side) of the head portion 10 in the long axis direction, an anisotropic deformation portion 70 extending to a rear end side of the neck portion 20, and a grip portion 30 extending to a rear end side of the anisotropic deformation portion 70 (hereinafter, the head portion 10, the neck portion 20, the grip portion 30, and the anisotropic deformation portion 70 are collectively referred to as a handle body 2).

The toothbrush 1 of the present embodiment is a molded body in which a hard portion H made of a hard resin and a soft portion E made of a soft resin are integrally molded. The hard portion H constitutes at least a portion of each of the head portion 10, the neck portion 20, the grip portion 30, and the anisotropic deformation portion 70. The soft portion E constitutes a portion of each of the grip portion 30 and the anisotropic deformation portion 70 (details will be described later).

Head Portion 10

The head portion 10 includes a bristle tufting surface 11 on one side in the thickness direction (a direction orthogonal to a paper surface in FIG. 1; a first direction). Hereinafter, the bristle tufting surface 11 side in the thickness direction is defined as a front side in a front surface direction, the side opposite to the bristle tufting surface is defined as a back side, and a direction orthogonal to the thickness direction and the long axis direction is defined as a width direction (or as appropriate, a side surface direction; a second direction). A plurality of bristle tufting holes 12 are formed on the bristle tufting surface 11. A bristle bundle of bristles (not illustrated) is tufted in the bristle tufting hole 12.

A width of the head portion 10, that is, a length in the width direction parallel to the bristle tufting surface 11 on the front side and orthogonal to the long axis direction (hereinafter, simply referred to as a width) is not particularly limited, and is preferably 7 mm or more and 13 mm or less, for example. When the width is the above lower limit value or more, a sufficient area for tufting the bristle bundle can be secured, and when the width is the above upper limit value or less, the operability in the oral cavity is further enhanced.

The length of the head portion 10 in the long axis direction (hereinafter, simply referred to as a length) is not particularly limited, and is preferably 10 mm or more and 33 mm or less, for example. When the length of the head portion 10 is the above lower limit value or more, a sufficient area for tufting the bristle bundle can be secured, and when the length is the above upper limit value or less, the operability in the oral cavity is further enhanced. A boundary between the neck portion 20 and the head portion 10 in the long axis direction in the present embodiment is a position where the width of the neck portion 20 is a minimum value from the neck portion 20 toward the head portion 10.

The length of the head portion 10 in the thickness direction (hereinafter, simply referred to as a thickness) can be determined in consideration of the material and the like, and is preferably 2.0 mm or more and 4.0 mm or less. When the thickness of the head portion 10 is the above lower limit value or more, the strength of the head portion 10 is further enhanced. When the thickness of the head portion 10 is the above upper limit value or less, the reachability to the rear of the molars can be enhanced and the operability in the oral cavity is further enhanced.

The bristle bundle is a bundle of a plurality of bristles. The length (bristle length) from the bristle tufting surface 11 to the tip end of the bristle bundle can be determined in consideration of a bristle waist and the like required for the bristle bundle, and is, for example, 6 to 13 mm. All the bristle bundles may have the same bristle length or may be different from each other.

A thickness of the bristle bundle (bristle bundle diameter) can be determined in consideration of the bristle waist and the like required for the bristle bundle, and is set to, for example, 1 to 3 mm. All the bristle bundles may have the same bristle bundle diameter or may be different from each other.

Examples of the bristles constituting the bristle bundle include bristles in which diameters gradually decrease toward a tip of the bristle and have sharpened tips of the bristles (tapered bristles), and bristles in which diameters from the bristle tufting surface 11 toward a tip of the bristle are substantially the same (straight bristles) as each other. Examples of a straight bristle include a bristle in which a tip of the bristle is a plane substantially parallel to the bristle tufting surface 11, and a bristle in which a tip of the bristle is hemispherically rounded.

Examples of the material of the bristle include polyamides such as 6-12 nylon (6-12NY), 6-10 nylon (6-10NY), polyesters such as polyethylene terephthalate (PET), polybutylene terephthalate (PBT), polytrimethylene terephthalate (PTT), polyethylene naphthalate (PEN), polybutylene naphthalate (PBN), polyolefins such as polypropylene (PP), elastomer resins such as polyolefin-based elastomers and styrene-based elastomers, and the like. These resin materials can be used alone or in a combination of two or more. In addition, examples of the bristle include a polyester bristle with a multi-core structure having a core portion and at least one or more layers of sheath portions provided on the outside of the core portion.

The cross-sectional shape of the bristle is not particularly limited, and may be a circular shape such as a perfect circle or an ellipse, a polygonal shape, a star shape, a three-leaf clover shape, a four-leaf clover shape, or the like. The cross-sectional shapes of all the bristles may be the same as each other or different from each other.

The thickness of the bristle can be determined in consideration of the material and the like, and in a case where the cross section is circular, the thickness is, for example, 6 to 9 mil (1 mil=1/1000 inch=0.025 mm). In addition, a plurality of bristles having different thicknesses may be used in any combination in consideration of usability, brushing feeling, cleaning effect, durability, and the like.

Neck Portion 20

The length of the neck portion 20 is preferably 40 mm or more and 70 mm or less in terms of operability.

As an example, the width of the neck portion 20 is formed to gradually increase from a position where the minimum value is obtained toward the rear end side. The neck portion 20 in the present embodiment is formed to gradually increase from a position where the width has a minimum value toward the rear end side. In addition, the neck portion 20 is formed to gradually increase from a position where the thickness has a minimum value toward the rear end side.

The width and thickness of the neck portion 20 at the minimum position are preferably 3.0 mm or more and 4.5 mm or less. When the width and thickness of the neck portion 20 at the minimum position are the above lower limit value or more, the strength of the neck portion 20 is further enhanced. When the width and thickness are the above upper limit value or less, the lips are likely to be closed, the reachability to the molars is enhanced, and the operability in the oral cavity is further enhanced. The width and thickness of the neck portion 20 formed to gradually increase from the position where the minimum value is obtained toward the rear end side can be appropriately determined in consideration of the material and the like.

The front side of the neck portion 20 in the side view is inclined toward the front side and toward the rear end side. The back side of the neck portion 20 in the side view is inclined toward the back side and toward the rear end side. The neck portion 20 is inclined in a direction where a distance from the center in the width direction increases toward the rear end side in a front view.

The boundary between the neck portion 20 and the anisotropic deformation portion 70 in the present embodiment is the position of the tip end on the neck portion 20 where an elastic deformation portion 90 that will be described later is provided. Here, the width is expanded from the neck portion 20 toward the grip portion 30 with an arcuate contour in both a front view and a side view, and a position of the center of curvature of the arc coincides with a changed position in the long axis direction. More specifically, the boundary between the neck portion 20 and the anisotropic deformation portion 70 coincides with a position in the long axis direction where the center of curvature changes from the outside of the arcuate contour to the center side in the width direction in the front view illustrated in FIG. 1. In addition, the boundary between the neck portion 20 and the anisotropic deformation portion 70 coincides with a position in the long axis direction where the center of curvature changes from the outside of the arcuate contour to the center side in the thickness direction in a side view illustrated in FIG. 2.

Grip Portion 30

The grip portion 30 is disposed in the long axis direction. As illustrated in FIG. 1, a length of the grip portion 30 in the width direction gradually narrows from the boundary with the anisotropic deformation portion 70 toward the rear end side, and then extends at a substantially constant length. As illustrated in FIG. 2, a length of the grip portion 30 in the thickness direction gradually narrows from the boundary with the anisotropic deformation portion 70 toward the rear end side, and then extends at a substantially constant length. The position in the long axis direction where the length of the grip portion 30 in the width direction gradually narrows from the boundary with the anisotropic deformation portion 70 toward the rear end side and then is a substantially constant length, and the position in the long axis direction where the length of the grip portion 30 in the thickness direction gradually narrows from the boundary with the anisotropic deformation portion 70 toward the rear end side and then is a substantially constant length are the same as each other.

The boundary between the anisotropic deformation portion 70 and the grip portion 30 in the present embodiment is the position of the tip end on the grip portion side 30 where the elastic deformation portion 90 that will be described later is provided. Here, the width is reduced from the anisotropic deformation portion 70 toward the grip portion side 30 with an arcuate contour in both a front view and a side view, and a position of the center of curvature of the arc coincides with a changed position in the long axis direction. More specifically, the boundary between the anisotropic deformation portion 70 and the grip portion 30 coincides with a position in the long axis direction where the center of curvature changes from the center side in the width direction to the outside of the arcuate contour in the front view illustrated in FIG. 1. In addition, the boundary between the anisotropic deformation portion 70 and the grip portion 30 coincides with a position in the long axis direction where the center of curvature changes from the center side in the thickness direction to the outside of the arcuate contour in the side view illustrated in FIG. 2.

The grip portion 30 includes a soft portion 31E at the center in the width direction on the front side. The soft portion 31E constitutes a portion of the soft portion E. The soft portion 31E gradually narrows from the boundary with the anisotropic deformation portion 70 toward the rear end side in the front view, and then extends at a substantially constant length. A side edge of the soft portion 31E and a side edge of the grip portion 30 on the outside in the width direction are formed at a substantially constant distance in the front view.

The grip portion 30 includes a hard portion 30H. The hard portion 30H constitutes a portion of the hard portion H. The hard portion 30H includes a hollow 31H in which a portion of the soft portion 31E is embedded on the front side. The hollow 31H gradually narrows from the boundary with the anisotropic deformation portion 70 toward the rear end side in the front view, and then extends at a substantially constant length.

A portion of the soft portion 31E protrudes from the hard portion 30H exposed on the front side. The other soft portion 31E is substantially flush with the hard portion 30H exposed on the front side.

The grip portion 30 includes a soft portion 32E at the center in the width direction on the back side (refer to FIGS. 1 and 2). The soft portion 32E constitutes a portion of the soft portion E. The soft portion 32E has substantially the same outer contour as the outer contour of the soft portion 31E in the front view. That is, the soft portion 32E gradually narrows from the boundary with the anisotropic deformation portion 70 toward the rear end side, and then extends at a substantially constant length. In a rear view, a side edge of the soft portion 32E and a side edge of the grip portion 30 on the outside in the width direction are formed at a substantially constant distance.

The hard portion 30H includes a hollow 32H (refer to FIG. 2) in which a portion of the soft portion 32E is embedded on the back side. The hollow 32H gradually narrows from the boundary with the anisotropic deformation portion 70 toward the rear end side in the rear view, and then extends at a substantially constant length.

A portion of the soft portion 32E protrudes from the hard portion 30H exposed on the back side. The other soft portion 32E is substantially flush with the hard portion 30H exposed on the front side.

Since the soft portion 31E is provided on the front side of the grip portion 30 and the soft portion 32E is provided on the back side, the grip property when the grip portion 30 is gripped is improved.

Anisotropic Deformation Portion 70

The anisotropic deformation portion 70 has anisotropy in which the deformation characteristics differ depending on the direction where the external force is applied. Specifically, the anisotropic deformation portion 70 has a bending strength in the thickness direction smaller than the bending strength in the width direction. That is, the anisotropic deformation portion 70 has a deformation characteristic (bending characteristic) that the anisotropic deformation portion 70 easily bends in the thickness direction (easily bends) and does not easily bend in the width direction (does not easily bend). In addition, the anisotropic deformation portion 70 has a function of sensing that the external force in the first direction orthogonal to the bristle tufting surface 11 exceeds the threshold value (details will be described later).

As illustrated in FIG. 1, the anisotropic deformation portion 70 includes a reversal portion 80 and an elastic deformation portion 90 which connect the neck portion 20 on the tip end side from the anisotropic deformation portion 70 and the grip portion 30 on the rear end side from the anisotropic deformation portion 70.

Figure 3:
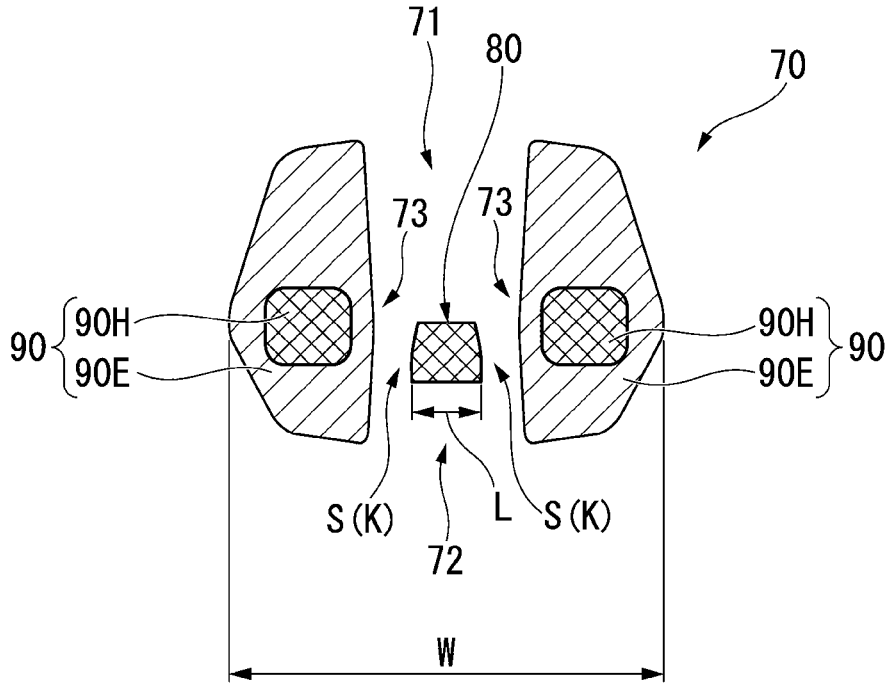
FIG. 3 is a cross-sectional view of an anisotropic deformation portion 70 along a plane parallel to a thickness direction and the width direction.
Figure 4:
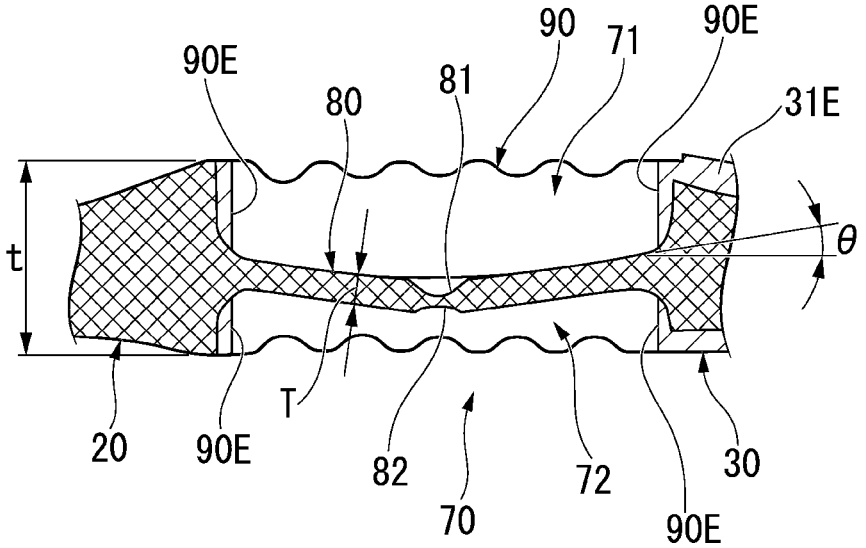
FIG. 4 is a cross-sectional view of the anisotropic deformation portion 70 along a plane parallel to the thickness direction and a long axis direction.

FIG. 3 is a cross-sectional view of the anisotropic deformation portion 70 along a plane parallel to a thickness direction and the width direction. FIG. 4 is a cross-sectional view of the anisotropic deformation portion 70 along a plane parallel to the thickness direction and a long axis direction.

As illustrated in FIG. 3, the elastic deformation portions 90 are each provided with gaps S on both sides of the reversal portion 80 in the width direction. The gaps S include a through-hole K penetrating in the thickness direction. As illustrated in FIG. 1, the through-hole K is formed in a rectangular shape in a plan view extending in the long axis direction.

By providing the gaps S, the reversal portion 80 can be reversed (easily reversed) without interfering with the periphery structure. In addition, since the elastic deformation portion 90 and the reversal portion 80 do not interfere with each other, the deformation of the reversal portion 80 does not follow the deformation of the elastic deformation portion, so that the functional roles (described later) of the reversal portion 80 and the elastic deformation portion 90 can be made independent. As a result, for example, the degree of freedom in design for obtaining the following effects can be enhanced. For example, vibration or sound when the reversal portion 80 that will be described later is reversed can be clearly generated. In addition, for example, a repulsive force up to the threshold value can be increased in proportion to the displacement amount, and in particular, the proportional relationship can be maintained even in the vicinity of the threshold value (the degree of increase in the repulsive force is not relaxed). As a result, the pressure assumed by the user is directly reflected in the repulsive force in the region up to the displacement amount reaching the upper limit pressure, so that the brushing load can be appropriately controlled. In a case where the degree of increase in the repulsive force is gradually relaxed in the vicinity of the threshold value, the user may unintentionally continue brushing at a pressure near the upper limit. In addition, when the gaps S are communicated with both sides of the reversal portion 80 in the thickness direction, the effect is further improved. By widening the gaps S in the thickness direction, the vector of the load applied to a brush portion (bristle) during brushing, the direction where the gaps open, and the direction where the reversal portion 80 and the elastic deformation portion 90 are deformed are made parallel to each other (refer to FIG. 7), and it is easy to link the generation of vibration or sound due to reversing with the brushing load. Furthermore, when the gaps S are passed through the front side and the back side by the through-hole K, for example, the movable region of the elastic deformation portion 90 which is responsible for the bending function of the toothbrush skeleton with respect to the load during brushing can be further expanded (the tensile behavior on the front surface and the compression behavior on the rear surface due to bending are unlikely to be hindered). In a case where there is no through-hole K between the elastic deformation portion 90 and the reversal portion 80, the movable region of the elastic deformation portion 90 is narrow. In this case, the reversal portion 80 is not assigned an opportunity to reverse in an appropriate load range, and it is assumed that the reversal portion 80 is reversed before reaching the appropriate load range, or is not reversed even within the appropriate load range. On the other hand, by providing the through-hole K between the elastic deformation portion 90 and the reversal portion 80, the "threshold value" at which the reversal portion 80 that will be described later reverses can be controlled in a fine range. The gap S may not penetrate in the thickness direction, and may be formed inside the elastic deformation portion 90 by a closed cavity extending in the long axis direction. In addition, the gaps S may include hollows (to be described later) that open on the front side or the back side.

Each elastic deformation portion 90 includes a hard portion 90H and a soft portion 90E. As illustrated in FIG. 1, the hard portion 90H and the soft portion 90E connect a rear end of the neck portion 20 and a front end of the grip portion 30. As illustrated in FIGS. 3 and 4, a hollow (recessed portion) 71 that opens on the front side and a hollow (recessed portion) 72 that opens on the back side are provided between the pair of elastic deformation portions 90. The bottom portions of the hollow 71 and the hollow 72 on both end sides in the width direction are connected to the through-holes K. The reversal portion 80 is exposed and provided at the bottom portions of the hollow 71 and the hollow 72 at the center in the width direction. By providing the hollows 71 and 72, for example, the movable region of the elastic deformation portion that bears the bending function of the toothbrush skeleton with respect to the load during brushing can be further expanded, and the bending anisotropy in the thickness direction can be improved. The hollows between the pair of elastic deformation portions 90 may not penetrate in the thickness direction, or may open in only one of the thickness directions. In addition, for example, a closed cavity extending in the long axis direction may be formed inside the elastic deformation portion 90, and the cavity may be interposed in the center to form a pair of elastic deformation portions in the width direction.

In the pair of elastic deformation portions 90, the end portions of the soft portions 90E in the long axis direction are connected to each other in the width direction on both the front side and the back side. The soft portions 90E of the pair of elastic deformation portions 90 are provided at the periphery of the oval hollows 71 and 72 in the front view. The rear end side of the soft portion 90E is connected to the soft portion 31E of the grip portion 30. Since the soft portion 90E is connected in the width direction on both the tip end side and the rear end side of the elastic deformation portion 90, stress is unlikely to be concentrated on the end of the hinge structure even when the reversing is repeated, and it is unlikely to break. In addition, the anisotropy in the anisotropic deformation portion 70 is increased by connecting the soft portions 90E in the width direction on both the tip end side and the rear end side of the elastic deformation portion 90. For example, the pair of elastic deformation portions 90 can be bent without twisting in the thickness direction with respect to the movement during brushing. Furthermore, since the soft portion 90E is connected in the width direction, the amount of heat possessed by the soft resin (elastomer) during injection molding increases, which enhances the adhesiveness between the neck portion 20 and the anisotropic deformation portion 70 (neck portion 20 and elastic deformation portion 90).

Figure 5:
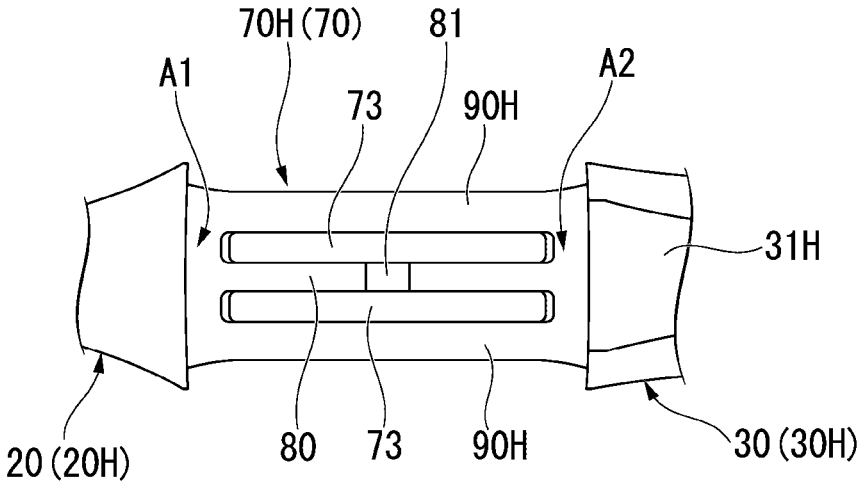
FIG. 5 is a partial front view in the vicinity of the anisotropic deformation portion 70 in a hard portion 70H.
Figure 6:
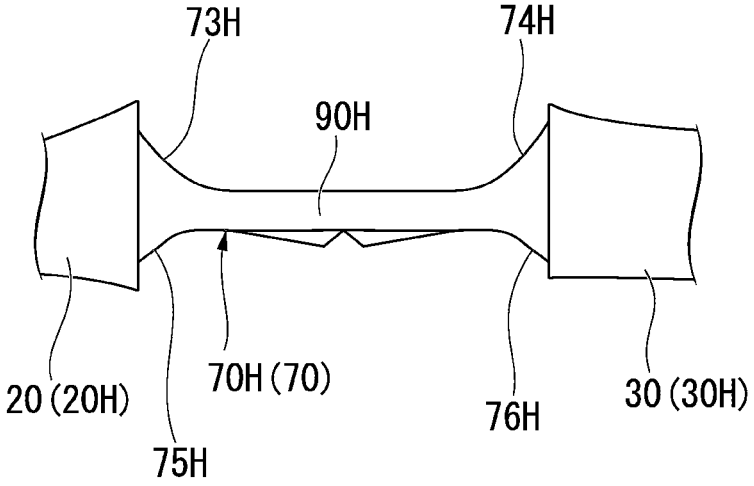
FIG. 6 is a partial side view in the vicinity of the anisotropic deformation portion 70 in the hard portion 70H.

FIG. 5 is a partial front view in a vicinity of a hard portion 70H in the anisotropic deformation portion 70. FIG. 6 is a partial side view in the vicinity of the hard portion 70H in the anisotropic deformation portion 70.

As illustrated in FIG. 5, the hard portion 70H is formed in a rectangular shape in a plan view connecting the hard portion 20H which is the neck portion 20 and the hard portion 30H of the grip portion 30 in the long axis direction.

As illustrated in FIG. 6, the tip end side of the hard portion 70H on the front side is connected to the hard portion 20H by a curved surface 73H having an arc shape in the side view. The rear end side of the hard portion 70H on the front side is connected to the hard portion 30H by a curved surface 74H having an arc shape in the side view. The arc centers of the curved surfaces 73H and 74H are located on the front side from the hard portion 70H in the side view. The tip end side of the hard portion 70H on the back side is connected to the hard portion 20H by a curved surface 75H having an arc shape in the side view. The rear end side of the hard portion 70H on the back side is connected to the hard portion 30H by a curved surface 76H having an arc shape in the side view. The arc centers of the curved surfaces 75H and 76H are located on the back side from the hard portion 70H in the side view. In a case where the curved surfaces 73H to 76H do not exist, stress may be concentrated on the boundary between the tip end side of the hard portion 70H and the hard portion 20H and the boundary between the rear end side of the hard portion 70H and the hard portion 30H. On the other hand, since the curved surfaces 73H to 76H exist, the concentrated stress can be relaxed. Furthermore, since the curved surfaces 73H to 76H exist, both the elastic deformation portion 90 and the tip end side and the rear end side of the reversal portion 80 can be flexibly deformed (the degree of deformation of the elastic deformation portion 90 that triggers reversing can be sensed more finely).

The hard portion 70H includes through-holes 73 provided on both sides of the reversal portion 80 in the width direction. The through-holes 73 extend in the long axis direction. The length of the through-holes 73 in the long axis direction is a length from the end portions of the hard portions 20H and 30H. As illustrated in FIG. 3, of the through-holes 73, the soft portion 90E is provided near the hard portion 90H in the width direction, and the through-hole K is formed near the reversal portion 80 in the width direction. In the hard portion 70H, since the hard portions 90H are disposed on both sides in the width direction with the reversal portion 80 as the center through the through-hole 73, even when a load is applied and the elastic deformation portion 90 is deformed, the shape of the reversal portion 80 can be maintained. When the hard portion H constituting the toothbrush 1 over the entire length is bent, the reversal portion 80 of the anisotropic deformation portion 70 is reversed in an attempt to release the accumulated strain energy. For example, in a case where the hard portion 70H is connected to the neck portion 20 and the grip portion 30 only by the reversal portion 80, since the energy cannot be accumulated, the hard portion 70H is immediately reversed. When the reversal portion 80 is integrally injection-molded with a first region A1 and a second region A2 that will be described later, the neck portion 20, the grip portion 30, and the hard portion 70H, the accumulated strain energy can be efficiently transferred to the reversal portion.

The hard portion 90H is formed on the outside of the hard portion 70H in the width direction from the through-hole 73. As illustrated in FIG. 3, the hard portion 90H has a substantially rectangular cross-sectional shape in which the long side extends in the width direction. The hard portion 90H is embedded in the soft portion 90E with the periphery covered. Since the hard portion 90H is embedded in the soft portion 90E, the stress applied to the hard portion 90H can be relaxed from the viewpoint of strength. In addition, from the viewpoint of the degree of bending of the toothbrush 1 with respect to the load, it is possible to control the elastic behavior of the elastic deformation portion 90. In addition, the bending anisotropy of the anisotropic deformation portion 70 is increased, and for example, the elastic deformation portion 90 can be bent without twisting in the thickness direction with respect to the movement during brushing.

A pair of hard portions 90H are disposed at the same position in the thickness direction. Since the pair of hard portions 90H are disposed at the same position in the thickness direction, the anisotropy in the anisotropic deformation portion 70 is enhanced, and the pair of elastic deformation portions 90 can bend without twisting in the thickness direction with respect to the movement during brushing. In addition, the position of the hard portion 90H in the thickness direction is preferably on the back side from the position where the thickness of the elastic deformation portion 90 is halved. Since the elastic deformation portion 90 is on the back side of the position where the thickness is halved, it is possible to ensure the ease of bending in the thickness direction while ensuring the behavior of immediately returning to the original shape when the load is released. The width of the hard portion 90H is preferably 2.0 mm or more. By setting the width of the hard portion 90H to 2.0 mm or more, it is possible to prevent bending in the width direction. The thickness of the hard portion 90H is preferably 2.0 mm or less. By setting the thickness of the hard portion 90H to 2.0 mm or less, it is easy for it to repeatedly bend in the thickness direction.

The minimum distance between the hard portion 90H and the contour on the outside of the anisotropic deformation portion 70 in the width direction, that is, the minimum thickness of the soft portion 90E on the outside from the hard portion 90H in the width direction, is preferably 1.0 mm or less. By setting the minimum thickness of the soft portion 90E to 1.0 mm or less, it is possible to prevent bending in the width direction.

Examples of the material of the hard portion H include a hard resin having a flexural modulus (JIS7171) of 1500 MPa or more and 3500 MPa or less, and for example, include a polyacetal resin (POM). The flexural modulus of the hard portion H is more preferably 2000 MPa or more and 3500 MPa or less. By using a material having a high elastic modulus (for example, POM), even when the shape is made narrow or thin, when an excessive load is applied, snap buckling occurs and vibration is developed. In addition, by using a material having a high elastic modulus, it is possible to rapidly return to an initial state (state where the bending of the elastic deformation portion 90 is released) after the snap buckling occurs.

As an example, the material of the soft portion E preferably has a shore hardness A of 50 or more and 90 or less, and more preferably a shore hardness A of 60 or more and 80 or less, so that the load on the teeth and the like remains within an appropriate range even when the brushing load increases until the snap buckling occurs. In a case where the shore hardness A is less than 50, the material may easily bend in the width direction. Examples of the soft resin include elastomers (for example, olefin-based elastomers, styrene-based elastomers, polyester-based elastomers, and polyurethane-based thermoplastic elastomers) and silicones. A styrene-based elastomer is preferable because styrene-based elastomers have excellent miscibility with polyacetal resins.

As a countermeasure against over-brushing in the toothbrush 1, it is effective to secure a flexible bending behavior and relax the brushing load. Therefore, in the bending behavior of the toothbrush 1 in the thickness direction, it is necessary for a load to be applied to the teeth and the like at as constant a pressure as possible even when the brushing pressure suddenly increases. However, when flexibility is applied not only in the thickness direction but also in the width direction during brushing, the pressure on the teeth to be originally applied is dispersed, which leads to a decrease in cleaning power. In addition, in a case where the head bends in various directions, the head portion 10 is unlikely to hit the target portion, which may lead to deterioration of operability.

On the other hand, because the toothbrush 1 of the present embodiment is provided with the anisotropic deformation portion 70 having anisotropy in bending strength, which is easily bent in the thickness direction and not easily bent in the width direction, it is possible to suppress the above-described decrease in cleaning power and the decrease in operability. In addition, since the anisotropic deformation portion 70 in the toothbrush 1 of the present embodiment includes the elastic deformation portion 90 in which the hard portion 90H is embedded in the soft portion 90E, and an appropriate elasticity acts as compared with the case where the elastic deformation portion 90 is formed only of the hard portion, the load on the teeth and the like is suppressed even when the brushing pressure rises sharply. In addition, as compared with the case where the elastic deformation portion 90 is formed only of the soft portion, the elastic deformation portion 90 immediately returns to the original shape when the load is released, and can cope with various movements of the head portion 10. Furthermore, in the present embodiment, since the pair of elastic deformation portions 90 are disposed side by side in the width direction, the bending in the width direction is suppressed with respect to the load in the thickness direction, so that the bending due to twisting can also be suppressed. As a result, it is possible to suppress the above-described decrease in cleaning power and the decrease in operability.

As illustrated in FIG. 5, the reversal portion 80 extends in the long axis direction in the front view, and is a second hard portion that connects the first region A1 on the tip end side of the through-hole 73 and the second region A2 on the rear end side of the through-hole 73 in the hard portion 70H. The reversal portion 80 is formed in substantially a V shape in a side view which gradually inclines toward the back side from both end portions in the long axis direction toward the center, in a first stable state (hereinafter referred to as a first state) illustrated in FIG. 4 in which no external force is applied to the back side of the head portion 10 (or an external force equal to or less than a predetermined threshold value that will be described later is applied). That is, in the first state, the reversal portion 80 is formed in a protrusion shape on the back side where the center in the long axis direction is the apex.

Figure 7:
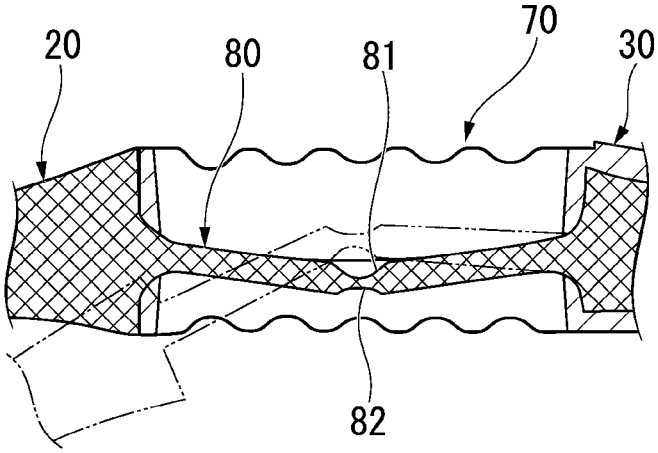
FIG. 7 is a cross-sectional view of the anisotropic deformation portion 70 along a plane parallel to the thickness direction and the long axis direction for describing reversal of a reversal portion.

As illustrated in FIG. 3, a portion of the reversal portion 80 overlaps with the hard portion 90H in the width direction in the first state. In addition, as illustrated in FIG. 7, a portion of the reversal portion 80 overlaps with the hard portion 90H in the width direction even in a second state that will be described later. Since a portion of the reversal portion 80 overlaps with the hard portion 90H in the width direction in both the first state and the second state, the anisotropy in the anisotropic deformation portion 70 increases, and the pair of elastic deformation portions 90 can be bent without twisting in the thickness direction with respect to the movement during brushing.

For example, when an external force to the back side is applied to the head portion 10 while the grip portion 30 is gripped, in a case where the magnitude of the external force is equal to or less than a predetermined threshold value, the elastic deformation portion 90 and the reversal portion 80 are elastically deformed according to the magnitude of the external force.

In a case where the magnitude of the external force exceeds a predetermined threshold value, the elastic deformation portion 90 elastically deforms according to the magnitude of the external force exceeding the threshold value. On the other hand, in a case where the magnitude of the external force exceeds a predetermined threshold value, as illustrated by a two dot chain line in FIG. 7, the reversal portion 80 snaps, buckles, and reverses to be in a second stable state (hereinafter referred to as a second state) when the neck portion 20 is deformed. In the second state, the reversal portion 80 is reversed in a direction that is substantially a reversed V shape in the side view which gradually inclines toward the front side toward the center. In the second state, the reversal portion 80 is formed in a protrusion shape on the front side where the center in the long axis direction is the apex.

That is, in a case where the magnitude of the external force exceeds a predetermined threshold value, since the elastic deformation portion 90 elastically deforms, the reversal portion 80 snaps, buckles, and reverses from the first state to the second state, in a state where the bending strength of the anisotropic deformation portion 70 is ensured. In addition, since the through-hole K is provided between the reversal portion 80 and the elastic deformation portion 90, the reversal portion 80 and the elastic deformation portion 90 can be deformed independently of each other, and the reversal portion 80 can be easily reversed. That is, since the through-hole K is provided when a brushing load is applied, the reversal portion 80 can be bent after only the elastic deformation portion 90 is first bent without either hindering the deformation behavior of the other. The space between the reversal portion 80 and the elastic deformation portion 90 does not necessarily penetrate, and a gap S may be formed.

In addition, relating to the load in the thickness direction on the head portion 10, the elastic deformation portion 90 can suppress the bending due to twisting by suppressing the bending in the width direction, so that it can contribute to the reversal portion 80 functioning accurately for the load in the thickness direction. Furthermore, for the reversing of the reversal portion 80, it is necessary to accumulate strain energy, and as described above, since the bending in the width direction is suppressed for the load in the thickness direction, the bending due to twisting is also suppressed, so that the load during brushing can be efficiently converted into strain energy. Therefore, in the present embodiment, the reversal portion 80 can be repeatedly buckled reliably at an appropriate timing.

Due to the vibration when the reversal portion 80 snaps, buckles, and reverses, the user who grips the grip portion 30 can sense that the external force applied to the head portion 10 on the back side exceeds the threshold value and is in an over-brushing state.

The reversal portion 80 includes a groove portion 81 at the center in the long axis direction on the front side, that is, in a region including an apex of the protrusion shape. The reversal portion 80 includes a groove portion 82 at the center in the long axis direction on the back side, that is, in a region including the apex of the protrusion shape. The groove portions 81 and 82 extend in the width direction. The groove portion 81 is formed in an arc shape in the side view in which the center of the arc is disposed on the front side. The groove portion 82 is formed in an arc shape in the side view in which the center of the arc is disposed on the back side. In a case where the reversal portion 80 is not provided with the groove portions 81 and 82, stress is uniformly generated in the entire reversal portion 80, and snap buckling is unlikely to occur. On the other hand, when the groove portions 81 and 82 are provided in the reversal portion 80, stress is intensively generated in the groove portions 81 and 82, and snap buckling is likely to occur.

The radius of the arc-shaped groove portions 81 and 82 in the side view is preferably 1 mm or more and 2 mm or less. In a case where the radius of the groove portions 81 and 82 is less than 1 mm, the reversal portion 80 may not be reversed. In a case where the radius of the groove portions 81 and 82 exceeds 2 mm, the vibration of the reversal portion 80 at the time of reversing is decreased, and the over-brushing state of the reversal portion 80 may be difficult to perceive.

As for the depth of the groove portions 81 and 82, it is preferable that the groove portion 81 is deeper than the groove portion 82. In a case where the groove portion 82 is deeper than the groove portion 81, the reversal portion 80 is unlikely to be reversed even in a case where the magnitude of the external force exceeds a predetermined threshold value. In addition, in a case where the groove portion 81 is deeper than the groove portion 82, the reversal portion 80 can be guided to be more likely to snap and buckle on the front side. Configurations in which neither of the groove portions 81 and 82 is provided and in which the groove portion 82 is not provided and only the groove portion 81 is provided are also possible.

Since the reversal portion 80 is provided with the groove portions 81 and 82 in the region including the apex of the protrusion shape, the region including the apex of the protrusion shape is thinner than the other regions. Therefore, the strain energy accumulated by the deformation of the reversal portion 80 due to the external force exceeding the threshold value can be instantly released starting from the groove portions 81 and 82, and the reversal portion 80 can be reversed. In addition, as described above, since the anisotropic deformation portion 70 has high anisotropy and is easily deformed in the thickness direction of the reversal portion 80, the strain energy accumulated by the deformation of the reversal portion 80 can contribute to functions such as efficient reversing of the reversal portion 80 in the thickness direction. Furthermore, the positions of the groove portions 81 and 82 in the thickness direction can be adjusted to adjust the position where the reversal portion 80 reverses from the first state to the second state.

In addition, since the groove portions 81 and 82 are formed in an arc shape in the side view, for example, as compared with the case where the groove portions 81 and 82 are formed in a V shape on two intersecting planes, even when the apex of the reversal portion 80 including the groove portions 81 and 82 moves in the thickness direction, the stress concentration at the apex can be relaxed.

The threshold value of the external force applied to the head portion 10 on the back side is, for example, an upper limit value of an appropriate brushing pressure.

As illustrated in FIG. 4, the angle A at which the reversal portion 80 is inclined to the plane parallel to the long axis direction and the width direction is preferably 5 degrees or more and 11 degrees or less, and more preferably 7 degrees or more and 11 degrees or less. In a case where the inclination angle θ is less than 5 degrees, since the reversal portion 80 is deformed without snap buckling, the over-brushing state may be difficult to perceive. In a case where the inclination angle θ exceeds 11 degrees, it may be difficult for the reversal portion 80 to snap, buckle, and reverse due to the over-brushing pressure, or when the reversal portion 80 snaps, buckles, and reverses, the reversal portion 80 may break and lose reversibility.

The thickness of the reversal portion 80 is preferably 1 mm or more and 2 mm or less, excluding the groove portions 81 and 82. In a case where the thickness of the reversal portion 80 is less than 1 mm, the reversal portion 80 does not snap and buckle while being deformed, and the over-brushing state may be difficult to perceive. When the thickness of the reversal portion 80 exceeds 2 mm, it may be difficult for the reversal portion 80 to snap, buckle, and reverse due to the over-brushing pressure, or when the reversal portion 80 snaps, buckles, and reverses, the reversal portion 80 may break and lose reversibility.

The width of the reversal portion 80 is preferably 1.5 mm or more. In a case where the width of the reversal portion 80 is less than 1.5 mm, the reversal portion 80 may easily bend in the width direction.

Assuming that the maximum thickness of the reversal portion 80 is T (mm) and the maximum thickness of the anisotropic deformation portion 70 is t (mm), by defining a value represented by T/t, it is possible to control the ease of reversing of the reversal portion 80 and the timing (threshold value) thereof when an excessive brushing load is applied. The value represented by T/t is preferably 0.05 or more and 0.35 or less, and more preferably 0.10 or more and 0.35 or less. In a case where the value represented by T/t is less than 0.05, although the reversal portion 80 also deforms in a form that follows the bending of the anisotropic deformation portion 70 (elastic deformation portion 90), the reversal portion 80 does not snap and buckle, and therefore the over-brushing state may be difficult to perceive. When the value represented by T/t exceeds 0.35, it may be difficult for the reversal portion 80 to snap, buckle, and reverse due to the over-brushing pressure, or when the reversal portion 80 snaps, buckles, and reverses, the reversal portion 80 may break and lose reversibility.

As illustrated in FIG. 3, assuming that the maximum width of the reversal portion 80 is L (mm) and the maximum width of the anisotropic deformation portion 70 is W (mm), by defining a value represented by L/W, for example, it is possible to control the ease of reversing of the reversal portion 80 and the timing (threshold value) thereof when an excessive brushing load is applied. The value represented by L/W is preferably 0.05 or more and 0.35 or less, and more preferably 0.10 or more and 0.35 or less. In a case where the value represented by L/W is less than 0.05, although the reversal portion 80 also deforms in a form that follows the bending of the anisotropic deformation portion 70 (elastic deformation portion 90), the reversal portion 80 is unlikely to snap and buckle, and therefore the over-brushing state may be difficult to perceive. When the value represented by L/W exceeds 0.35, the reversal portion 80 is unlikely to be deformed and reversed due to the bending of the handle body 2 that occurs in the range of normal brushing. Therefore, it may be difficult for the reversal portion 80 to snap, buckle, and reverse due to the over-brushing pressure, or when the reversal portion 80 snaps, buckles, and reverses, the reversal portion 80 may break and lose reversibility. That is, by setting T/t and L/W within the above ranges, the bending strength of the reversal portion 80 is flexible at a constant ratio for the elastic deformation portion 90, and the reversal portion 80 can be operated with a slight delay for the bending of the elastic deformation portion 90 that bears the handle skeleton. Therefore, even when an excessive brushing load is applied, it is possible to control the ease of reversing of the reversal portion 80 and the timing (threshold value) that triggers the reversal portion 80 to reverse.

The length of the reversal portion 80 in the long axis direction is preferably 15 mm or more and 30 mm or less, more preferably 15 mm or more and 25 mm or less, and even more preferably 15 mm or more and 20 mm or less. The position of the tip end side end portion of the reversal portion 80 is the position of the tip end side end portion of the through-hole 73. The position of the rear end side end portion of the reversal portion 80 is the position of the rear end side end portion of the through-hole 73. In a case where the length of the reversal portion 80 in the long axis direction is less than 15 mm, it may be difficult for the reversal portion 80 to snap, buckle, and reverse due to the normal brushing pressure, and the deformation required for snap buckling to develop may not be generated. In a case where the length of the reversal portion 80 in the long axis direction exceeds 30 mm, the displacement required for snap buckling is significantly increased, which significantly reduces usability and the deformation behavior of the reversal portion 80 may be the same as that of the elastic deformation portion 90.

The reversal portion 80 is located between the outer contour of the bristle tufting surface side 11 and the outer contour of the back side of the elastic deformation portion 90 in the side view. More specifically, the position of the reversal portion 80 in the thickness direction is set so as not to protrude from the thickness of the elastic deformation portion 90 in the side view so that the reversal portion does not form the outermost contour of the toothbrush. Therefore, for example, it is possible to prevent the reversal portion from coming into contact with the user during use. Specifically, it is preferable that the elastic deformation portion 90 be on the back side of the position where the thickness is halved. In a case where the position of the reversal portion 80 in the thickness direction is on the back side of the position where the thickness of the anisotropic deformation portion 70 is halved, when the reversal portion 80 is reversed to be in the second state, the possibility of the apex of the reversal portion 80 protruding from the front surface on the front side of the elastic deformation portion 90 and coming into contact with the user s finger can be reduced. In addition, since the reversal portion 80 is disposed on the back side of the position where the thickness of the elastic deformation portion 90 is halved, when the reversal portion 80 is bent, the back side is compressed rather than the front side, and therefore energy that triggers the reversing easily accumulates, and the strain energy can be efficiently transferred to the reversal portion 80.

The flexural modulus of the hard resin constituting the reversal portion 80 is preferably 1500 MPa or more and 3500 MPa or less, and more preferably 2000 MPa or more and 3500 MPa or less. In a case where the flexural modulus of the hard resin is less than 1500 MPa, the reversal portion 80 does not snap and buckle while being deformed, and the over-brushing state may be difficult to perceive. In a case where the flexural modulus of the hard resin exceeds 3500 MPa, it may be difficult for the reversal portion 80 to snap, buckle, and reverse due to the over-brushing pressure, or when the reversal portion 80 snaps, buckles, and reverses, the reversal portion 80 may break and lose reversibility. In addition, by using a material having a defined flexural modulus, vibrations associated with snap buckling are intensively generated in a short time and are sensitive (sharp, large). As a result, the user can easily become aware of the over-brushing.

When the reversal portion 80 snaps and buckles, the moving distance of the apex of the protrusion shape in the thickness direction is preferably 0.2 mm or more and 5.0 mm or less. In a case where the moving distance of the apex in the thickness direction is less than 0.2 mm, the vibration at the time of snap buckling is decreased, and the over-brushing state may be difficult to perceive. In a case where the moving distance of the apex in the thickness direction exceeds 5.0 mm, it may be difficult for the reversal portion 80 to snap, buckle, and reverse due to the over-brushing pressure, or when the reversal portion 80 snaps, buckles, and reverses, the reversal portion 80 may break and lose reversibility. When the moving distance of the reversal portion 80 is within the above range when the snap buckling occurs, the vibration generated by the snap buckling is intensively generated in a short time and is sensitive (sharp, large). As a result, the user can easily become aware of the over-brushing.

The thickness of the hard portion 90H in the elastic deformation portion 90 is preferably 2.0 mm or less, and the width is preferably larger than the thickness. In a case where the thickness of the hard portion 90H is 2.0 mm or less, the hard portion 90H is in a plane stress state, and therefore the hard portion 90H is unlikely to generate internal stress. As a result, the elastic deformation portion 90 is unlikely to break even when deformed, and the energy required for reversing the reversal portion 80 can be sufficiently accumulated. In addition, as a result, the anisotropy of the bending behavior of the elastic deformation portion 90 can be clarified, and twisting can be made difficult.

In addition, in the toothbrush 1 of the present embodiment, since the reversal portion 80 and the elastic deformation portion 90 are disposed with a gap in the width direction, the anisotropic deformation portion 70 can be more easily deformed on the front side and the back side, and can be in a plane stress state where the anisotropic deformation portion 70 is substantially not deformed in the long axis direction and the width direction. That is, in the toothbrush 1 of the present embodiment, the directions where the reversal portion 80 and the elastic deformation portion 90 are deformed are the thickness directions separated from each other in the width direction, and are not present on the same plane. In other words, a path where the elastic deformation portion 90 is deformed due to the external force in the thickness direction and a path where the reversal portion 80 is deformed due to the external force in the thickness direction are provided in a non-interfering manner. Therefore, in the toothbrush 1 of the present embodiment, since the elastic deformation portion 90 and the reversal portion 80 are unlikely to be constrained by each other and can be deformed, it is possible to more sufficiently accumulate the energy required for the reversing of the reversal portion 80, stress is intensively generated in the reversal portion 80 (particularly the groove portions 81 and 82), and a sharp snap buckling is developed.

In particular, in the toothbrush 1 of the present embodiment, since the pair of hard portions 90H in the elastic deformation portion 90 are disposed at the same position in the thickness direction, and a portion of the reversal portion 80 overlaps with the hard portion 90H in the width direction in the first state, for example, even when an external force in the width direction is applied to the head portion 10, twisting around the axis extending in the long axis direction is unlikely to occur. Therefore, in the toothbrush 1 of the present embodiment, the anisotropic deformation portion 70 is unlikely to be deformed in the width direction, and the bending strength can be increased.

As illustrated in FIG. 3, in the cross section orthogonal to the long axis direction, an occupancy rate of the space of the hollows 71 and 72 represented by the ratio of the cross-sectional areas of the spaces of the hollows 71 and 72 (cross-sectional area obtained by subtracting the cross-sectional area of the pair of elastic deformation portions 90 and the cross-sectional area of the reversal portion 80 from the maximum cross-sectional area of the anisotropic deformation portion 70) to the maximum cross-sectional area of the anisotropic deformation portion 70 is preferably 20% or more and 60% or less. Here, the maximum cross-sectional area of the anisotropic deformation portion 70 is an area of a figure formed by virtually connecting the outermost contour on the front side of the pair of elastic deformation portions 90 and virtually connecting the outermost contour on the back side of the pair of elastic deformation portions 90, in the cross section orthogonal to the long axis direction of the anisotropic deformation portion 70 illustrated in FIG. 3.

In a case where the occupancy rate is less than 20%, the occupancy rate of the elastic deformation portion 90 and the reversal portion 80 is increased, and the bending strength toward the back side in the thickness direction is increased during brushing. In this case, it is difficult to maintain an appropriate brushing pressure, and it may be difficult to suppress over-brushing. In a case where the occupancy rate exceeds 60%, the occupancy rate of the elastic deformation portion 90 and the reversal portion 80 is decreased, and the bending strength in the width direction is decreased during brushing. In this case, the bending is increased against an external force in the width direction during brushing, and it may be difficult to accurately brush the dentition tooth by tooth.

The length of the anisotropic deformation portion 70 in the long axis direction is preferably 15 mm or more and 30 mm or less, more preferably 15 mm or more and 25 mm or less, and even more preferably 15 mm or more and 20 mm or less.

In a case where the length of the anisotropic deformation portion 70 in the long axis direction is less than 15 mm, the bending strength toward the back side in the thickness direction is increased during brushing. In this case, it is difficult to maintain an appropriate brushing pressure, and it may be difficult to suppress over-brushing.

When the length of the anisotropic deformation portion 70 in the long axis direction exceeds 30 mm, the bending strength in the width direction is decreased during brushing. In this case, the bending is increased against an external force in the width direction during brushing, and it may be difficult to accurately brush the dentition tooth by tooth.

In the above toothbrush 1, it is preferable that any bending load when the head portion 10 is displaced in the thickness direction with the displacement amount of 10 mm, 20 mm, or 30 mm in a state where the grip portion 30 is supported be lower than the bending load when the head portion 10 is displaced in the width direction with the displacement amount of 10 mm. As a result, sufficient anisotropy is generated in the thickness direction and the width direction with respect to the bending strength, an appropriate brushing pressure that can suppress over-brushing can be easily maintained, and the dentition can be accurately brushed tooth by tooth.

In the above toothbrush 1, the difference between the bending load when the head portion 10 is displaced on the back side in the thickness direction with a reference displacement amount in a state where the grip portion 30 is supported and the bending load when the head portion 10 is displaced in the width direction with the above reference displacement amount is preferably 5.0 N or more in all of the reference displacement amounts of 10 mm, 20 mm, and 30 mm.

In a case where the difference in bending load due to the difference in the displacement direction (thickness direction or width direction) is less than 5 N, the bending strength toward the back side in the thickness direction may be increased during brushing, or the bending may increase against an external force in the width direction during brushing. In addition, it is preferable that the bending load in the side surface direction (width direction) be 5 N or more at any time of displacement in the thickness direction and the width direction. In addition, the bending load in the thickness direction (front surface direction) is preferably 3 N or less at both the displacement in the thickness direction and the displacement in the width direction.

In addition, in the above toothbrush 1, it is preferable that any difference between the bending load when the head portion 10 is displaced in the thickness direction with a reference displacement amount of 10 mm or 20 mm in a state where the grip portion 30 is supported and the bending load when the head portion 10 is displaced in the width direction with a reference displacement amount of 10 mm be 4.0 N or more, and that the bending load when displaced in the width direction be large. As a result, sufficient anisotropy is generated in the thickness direction and the width direction with respect to the bending strength, an appropriate brushing pressure that can suppress over-brushing can be easily maintained, and the dentition can be accurately brushed tooth by tooth.

Similarly, the ratio of the bending load when the head portion 10 is displaced in the width direction with the reference displacement amount to the bending load when the head portion 10 is displaced on the back side in the thickness direction with a reference displacement amount in a state where the grip portion 30 is supported is preferably 5.0 or more for all of the reference displacement amounts of 10 mm, 20 mm, and 30 mm. In a case where the ratio of the bending load when displaced on the back side with the reference displacement amount to the bending load when displaced in the width direction with the reference displacement amount is less than 5.0, the bending strength toward the back side in the thickness direction may be increased during brushing, or the bending may increase against an external force in the width direction during brushing. Therefore, when the ratio of the bending load when displaced on the back side with the reference displacement amount to the bending load when displaced in the width direction with the reference displacement amount is 5.0 or more, sufficient anisotropy is generated in the width direction with respect to the bending strength, an appropriate brushing pressure that can suppress over-brushing can be easily maintained, and the dentition can be accurately brushed tooth by tooth.

In addition, it is preferable that any ratio of the bending load when the head portion 10 is displaced in the thickness direction with a reference displacement amount of 10 mm or 20 mm in a state where the grip portion 30 is supported to the bending load when the head portion 10 is displaced in the width direction with a reference displacement amount of 10 mm be 2.0 or more, and that the bending load when displaced in the width direction be large. As a result, sufficient anisotropy is generated in the thickness direction and the width direction with respect to the bending strength, an appropriate brushing pressure that can suppress over-brushing can be easily maintained, and the dentition can be accurately brushed tooth by tooth.

As described above, since the toothbrush 1 of the present embodiment includes the anisotropic deformation portion 70 that exhibits anisotropy in bending strength in the thickness direction and the width direction during brushing, any bending load when the head portion 10 is displaced on the back side in the thickness direction with the reference displacement amount of 10 mm, 20 mm, or 30 mm in a state where the grip portion 30 is supported can be lower than the bending load when the head portion 10 is displaced in the width direction with the reference displacement amount of 10 mm. Therefore, in the toothbrush 1 of the present embodiment, an appropriate brushing pressure that can suppress over-brushing can be easily maintained, and the dentition can be accurately brushed tooth by tooth.

EXAMPLE

Hereinafter, the present invention will be described in detail with reference to examples, but the present invention is not limited to the following examples, and can be appropriately modified and performed without departing from the gist thereof.

Examples 1 to 9, Comparative Examples 1 to 2

Samples of Examples 1 to 9 and Comparative Examples 1 and 2 in which the bending loads when the head portion is displaced on the back side in the thickness direction and in the width direction with the reference displacement amounts of 10 mm, 20 mm, and 30 mm were the values illustrated in [Table 1] were prepared. In addition, for the samples of Examples 1 to 9 and Comparative Example 2, the presence or absence of a through-hole in the thickness direction, the occupancy rate of the cross-sectional area of the space of the recessed portion, and the presence or absence of the reversal portion were prepared according to the specification illustrated in [Table 1]. In addition, Clinica Kid s for 3 to 5 years old manufactured by Lion Corporation was used as a sample of Comparative Example 1.

Test Method for Bending Load

Each test was performed for 3 pieces (n=3) of each sample which was subjected to a test in which a load was applied to the bristle tufting surface of the head portion on the back side in the thickness direction and a test in which a load was applied to the head portion in the width direction. For each test, an autograph tester (AGS-X, manufactured by SHIMADZU Corporation) was used as an evaluation device. In the load application test, the grip portion side was chucked from the boundary between the anisotropic deformation portion and the grip portion so that the head portion was horizontal in the front view or the side view, and a load was applied vertically downward to each central portion of the head portion in the front view and the side view (load cell: 100 N and test speed 20 mm/min), and the bending load was measured at each position of the displacement amounts of 10 mm, 20 mm, and 30 mm.

The difference between a bending load A measured by applying a load to the back side in the thickness direction and a bending load B measured by applying a load in the width direction and the ratio of the large value of the bending load A and the bending load B to the small value of the bending load A and the bending load B were calculated for each position of the displacement amounts of 10 mm, 20 mm, and 30 mm.

Evaluation Method (1) Maintaining Appropriate Brushing Load

[Test method] A specialized panel (5 people) brushed with each sample and evaluated a feeling that an excessive brushing load can be relaxed by bending and an appropriate brushing load can be maintained on a 5-point scale in actual use, and the average score was evaluated. The average value of the scores was rounded off between the second decimal place and the first decimal place.

[Score] 5 points: Significantly felt, 4 points: Slightly felt, 3 points: Unclear, 2 points: Not felt much, 1 point: Not felt at all

[Evaluation] ◎: 4.6 to 5 points, ○: 4.1 to 4.5 points, Δ: 3.1 to 4.0 points, ×: 3.0 points or less (2) Brushing Carefully

[Test method] A specialized panel (5 people) brushed with each sample and evaluated the feeling of brushing tooth by tooth carefully on a 5-point scale in actual use, and the average score was evaluated.

[Score] 5 points: Significantly felt, 4 points: Slightly felt, 3 points: Unclear, 2 points: Not felt much, 1 point: Not felt at all

[Evaluation] ◎: 4.6 to 5 points, ○: 4.1 to 4.5 points, Δ: 3.1 to 4.0 points, ×: 3.0 points or less (3) Vibration Development of Reversal Portion

[Test method] A specialized panel (5 people) brushed with each sample and evaluated whether or not they felt vibration when the reversal portion was reversed on a 5-point scale in actual use, and the average value of the scores was evaluated as follows. The average value of the scores was rounded off between the second decimal place and the first decimal place.

[Score] 5 points: Significantly felt, 4 points: Slightly felt, 3 points: Unclear, 2 points: Not felt much, 1 point: Not felt at all

[Evaluation] ◎: 4.6 to 5 points, ○: 4.1 to 4.5 points, Δ: 3.1 to 4.0 points, ×: 3.0 points or less (4) Reversible Reversing of Reversal Portion

[Test method] A specialized panel (5 people) used each sample for 1 week and evaluated the presence or absence of reversing after 1 week.

[Evaluation] ○: Presence of reversing, and ×: Absence of reversing (× when not even one piece was reversed)

For the evaluation results, ◎, ○, and Δ were regarded as passing (OK), and ×was evaluated as failing (NG).

In the evaluation of the measured load, by developing the vibration at the time of reversing in the range of 230 to 250 g, for example, the load when the user actually brushes with the toothbrush 1 is a value of 200 g, which is the recommended value.

TABLE 1

| | | Example 1 | Example 2 | Example 3 | Example 4 | Example 5 | Example 6 | Example 7 | Example 8 | Example 9 | Comparative Example 1 | Comparative Example 2 |
|---|---|---|---|---|---|---|---|---|---|---|---|---|
| Displacement amount 10 mm | A: Bending load toward back side in thickness direction (N) | 0.9 | 1.1 | 2.3 | 4.5 | 0.6 | 0.8 | 2.5 | 6.1 | 0.5 | 3.2 | 2.1 |
| | B: Bending load in width direction (N) | 6.8 | 7.1 | 8.1 | 9.6 | 6.8 | 6.8 | 8.4 | 12.2 | 5.6 | 1.9 | 6.3 |
| | Difference between bending load A and B; B − A (N) | 5.9 | 6.0 | 5.8 | 5.1 | 6.2 | 6.0 | 5.9 | 6.1 | 5.1 | 1.3 | 4.2 |
| | Large value/small value of bending load A and B; B/A | 7.6 | 6.5 | 3.5 | 2.1 | 11.3 | 8.5 | 3.4 | 2.0 | 11.2 | 1.7 | 3.0 |
| Displacement amount 20 mm | A: Bending load toward back side in thickness direction (N) | 1.2 | 1.8 | 3.8 | 5.3 | 0.9 | 1.4 | 3.5 | 8.1 | 1.0 | 4.1 | 2.8 |
| | B: Bending load in width direction (N) | 11.4 | 11.9 | 12.9 | 14.2 | 11.1 | 11.5 | 12.8 | 15.4 | 9.3 | 2.7 | 7.2 |
| | Difference between bending load A and B; B − A (N) | 10.2 | 10.1 | 9.1 | 8.9 | 10.2 | 10.1 | 9.3 | 7.3 | 8.3 | 1.4 | 4.4 |
| | Large value/small value of bending load A and B; B/A | 9.5 | 6.6 | 3.4 | 2.7 | 12.3 | 8.2 | 3.7 | 1.9 | 9.3 | 1.5 | 2.6 |
| Displacement amount 30 mm | A: Bending load toward back side in thickness direction (N) | 1.6 | 2.1 | 3.5 | 5.8 | 1.3 | 1.7 | 3.4 | 7.6 | 1.2 | 2.7 | 3.1 |
| | B: Bending load in width direction (N) | 10.5 | 11 | 12.1 | 13.5 | 10.1 | 10.6 | 11.8 | 15 | 9.7 | 0.8 | 8.1 |
| | Difference between bending load A and B; B − A (N) | 8.9 | 8.9 | 8.6 | 7.7 | 8.8 | 8.9 | 8.4 | 7.4 | 8.5 | 1.9 | 5.0 |
| | Large value/small value of bending load A and B; B/A | 6.6 | 5.2 | 3.5 | 2.3 | 7.8 | 6.2 | 3.5 | 2.0 | 8.1 | 3.4 | 2.6 |
| Presence or absence of through-hole in thickness direction | | Presence | Presence | Absence | Absence | Presence | Presence | Presence | Presence | Presence | — | Presence |
| Occupancy rate of cross-sectional area of space of recessed portion | | 52% | 31% | 20% | 0% | 55% | 35% | 30% | 33% | 70% | — | 31% |
| Presence or absence of reversal portion | | Presence | Presence | Presence | Absence | Absence | Absence | Presence | Presence | Presence | — | Presence |
| Difference between bending load A with displacement amount of 10 mm in thickness direction and bending load B with displacement amount of 10 mm in width direction; B − A (N) | | 5.9 | 6.0 | 5.8 | 5.1 | 6.2 | 6.0 | 5.9 | 6.1 | 5.1 | −1.3 | 4.2 |
| Difference between bending load A with displacement amount of 20 mm in thickness direction and bending load B with displacement amount of 10 mm in width direction; B − A (N) | | 5.6 | 5.3 | 4.3 | 4.3 | 5.9 | 5.4 | 4.9 | 4.1 | 4.6 | −2.2 | 3.5 |
| Difference between bending load A with displacement amount of 30 mm in thickness direction and bending load B with displacement amount of 10 mm in width direction; B − A (N) | | 5.2 | 5.0 | 4.6 | 3.8 | 5.5 | 5.1 | 5.0 | 4.6 | 4.4 | −0.8 | 3.2 |
| Ratio of bending load B with displacement amount of 10 mm in width direction to bending load A with displacement amount of 10 mm in thickness direction; B/A | | 7.6 | 6.5 | 3.5 | 2.1 | 11.3 | 8.5 | 3.4 | 2.0 | 11.2 | 0.6 | 3.0 |
| Ratio of bending load B with displacement amount of 10 mm in width direction to bending load A with displacement amount of 20 mm in thickness direction; B/A | | 5.7 | 3.9 | 2.1 | 1.8 | 7.6 | 4.9 | 2.4 | 1.5 | 5.6 | 0.5 | 2.3 |
| Ratio of bending load B with displacement amount of 10 mm in width direction to bending load A with displacement amount of 30 mm in thickness direction; B/A | | 4.3 | 3.4 | 2.3 | 1.7 | 5.2 | 4.0 | 2.5 | 1.6 | 4.7 | 0.7 | 2.0 |
| Usability (feeling that excessive brushing load can be relaxed by bending and appropriate brushing load can be maintained) | | ◎ | ◎ | ○ | ○ | ◎ | ◎ | ○ | Δ | Δ | X | X |
| Usability (feeling of brushing tooth by tooth carefully) | | ◎ | ◎ | ◎ | ◎ | ◎ | ◎ | ○ | ○ | Δ | X | Δ |
| Vibration development of reversal portion | | ◎ | ◎ | ○ | — | — | — | ○ | ○ | ○ | — | ○ |
| Reversible reversing | | ○ | ○ | ○ | — | — | — | ○ | ○ | ○ | — | ○ |

As illustrated in [Table 1], the samples of Examples 1 to 9 in which any bending load A when displaced in the thickness direction with the displacement amount of 10 mm, 20 mm, or 30 mm was lower than the bending load B when displaced in the width direction with the displacement amount of 10 mm passed (OK) in the items of maintaining an appropriate brushing load and brushing carefully, and it was confirmed that an appropriate brushing pressure able to suppress over-brushing could be easily maintained, and that the dentition could be accurately brushed tooth by tooth. Furthermore, the samples of Examples 1 to 9 in which the difference between the bending load A and the bending load B was 5.0 N or more in all of the displacement amounts of 10 mm, 20 mm, and 30 mm, and any difference between the bending load A when displaced in the thickness direction with the displacement amounts of 10 mm or 20 mm and the bending load B when displaced in the width direction with the displacement amount of 10 mm was 4.0 N or more, passed (OK) in the items of maintaining an appropriate brushing load and brushing carefully, and it was confirmed that an appropriate brushing pressure able to suppress over-brushing could be easily maintained, and that the dentition could be accurately brushed tooth by tooth.

In addition, the samples of Examples 1 to 3 and 7 to 9, in which any bending load A when displaced in the thickness direction with the displacement amount of 10 mm, 20 mm, or 30 mm was lower than the bending load B when displaced in the width direction with the displacement amount of 10 mm, and which included the reversal portion, also passed (OK) in the items of vibration development of the reversal portion and reversible reversing of the reversal portion with an evaluation of ○ or higher, and it is possible to easily recognize that the over-brushing state is caused by the vibration portion, and it is possible to suppress deterioration of usability.

Furthermore, the samples of Examples 1 to 3, 5 to 7, and 9, in which any ratio (B/A) of the bending load A when displaced in the thickness direction with the displacement amounts of 10 mm or 20 mm and the bending load B when displaced in the width direction with the displacement amount of 10 mm was 2.0 or more, passed (OK) in the items of maintaining an appropriate brushing load and brushing carefully, and it was confirmed that an appropriate brushing pressure able to suppress over-brushing could be easily maintained, and that the dentition could be accurately brushed tooth by tooth.

In addition, the samples of Examples 1 to 2 and 9 which included the reversal portion and in which the ratio of the large value to the small value of the bending load was 5.0 or more in all of the displacement amounts of 10 mm, 20 mm, and 30 mm passed (OK) in the items of vibration development of the reversal portion and reversible reversing of the reversal portion with an evaluation of ○ or higher, and it is possible to easily recognize that the over-brushing state is caused by the vibration portion, and it is possible to suppress deterioration of usability.

On the other hand, the sample of Comparative Example 1 in which any bending load A when displaced in the thickness direction with the displacement amount of 10 mm, 20 mm, or 30 mm was not lower than the bending load B when displaced in the width direction with the displacement amount of 10 mm failed (NG) in the items of maintaining an appropriate brushing load and brushing carefully, and it was confirmed that maintaining an appropriate brushing pressure able to suppress over-brushing, and accurately brushing the dentition tooth by tooth could not be achieved.

In addition, the sample of Comparative Example 1 which did not satisfy the difference between the bending load A and the bending load B of 5.0 N or more in all of the displacement amounts of 10 mm, 20 mm, and 30 mm, and in which any difference between the bending load A when displaced in the thickness direction with the displacement amounts of 10 mm or 20 mm and the bending load B when displaced in the width direction with the displacement amount of 10 mm was 4.0 N or more, and any ratio (B/A) of the bending load B when displaced in the width direction with the displacement amount of 10 mm to the bending load A when displaced in the thickness direction with the displacement amounts of 10 mm or 20 mm was 2.0 or more, failed (NG) in the items of maintaining an appropriate brushing load and brushing carefully, and it was confirmed that maintaining an appropriate brushing pressure able to suppress over-brushing, and accurately brushing the dentition tooth by tooth could not be achieved.

In addition, in the sample of Comparative Example 2 which did not satisfy the difference between the bending load A and the bending load B of 5.0 N or more in all of the displacement amounts of 10 mm, 20 mm, and 30 mm, and in which any difference between the bending load A when displaced in the thickness direction with the displacement amounts of 10 mm or 20 mm and the bending load B when displaced in the width direction with the displacement amount of 10 mm was 4.0 N or more, and any ratio (B/A) of the bending load B when displaced in the width direction with the displacement amount of 10 mm to the bending load A when displaced in the thickness direction with the displacement amounts of 10 mm or 20 mm was 2.0 or more, failed (NG) in the item of maintaining an appropriate brushing load, and it was confirmed that maintaining an appropriate brushing pressure able to suppress over-brushing could not be achieved.

Although the preferred embodiments according to the present invention are described above with reference to the accompanying drawings, it goes without saying that the present invention is not limited to the above examples. The various shapes and combinations of the constituent members described in the above-described examples are examples, and can be variously changed based on design requirements and the like without departing from the gist of the present invention.

For example, in the above embodiment, the configuration in which the anisotropic deformation portion 70 is provided between the neck portion 20 and the grip portion 30 is illustrated, but the invention is not limited to this configuration. The anisotropic deformation portion 70 may have a configuration provided in the neck portion 20 or a configuration provided in the grip portion 30.

In addition, although the configuration in which one reversal portion 80 is provided in the anisotropic deformation portion 70 is illustrated in the above embodiment, the invention is not limited to this configuration, and a configuration in which a plurality of reversal portions 80 are provided may be provided.

For example, in a case where two reversal portions 80 are provided, one is formed to have a thickness and inclination angle A that are reversed at the upper limit value of the appropriate brushing load, and the other is formed to have a thickness and inclination angle that are reversed at the lower limit value of the appropriate brushing load. Therefore, it is possible to easily define both the upper limit value and the lower limit value of the brushing load.

In addition, although the configuration in which the anisotropic deformation portion 70 includes the elastic deformation portion 90 and the reversal portion 80 is illustrated in the above embodiment, the invention is not limited to this configuration. For example, the anisotropic deformation portion 70 may have a configuration in which the periphery of the hard portion 90H is covered with the soft portion 90E and includes the elastic deformation portion 90, without having the reversal portion, the hollows 71 and 72, and the through-hole K.

In addition, although a configuration in which a portion of the hollows 71 and 72 penetrates in the thickness direction through the through-hole K is illustrated in the above embodiment, the invention is not limited to this configuration, and a configuration in which only one of the front side or the back side is opened may be provided.

INDUSTRIAL APPLICABILITY

The present invention can be applied to a toothbrush.

REFERENCE SIGNS LIST

1: Toothbrush
2: Handle body
10: Head portion
11: Bristle tufting surface
20: Neck portion
30: Grip portion
70: Anisotropic deformation portion
71, 72: Hollow (recessed portion)
80: Reversal portion (second hard portion)
81, 82: Groove portion
90: Elastic deformation portion
90H: Hard portion (first hard portion)
A1: First region
A2: Second region
E, 31E, 32E: Soft portion
H: Hard portion
S: Gap

What is claimed is:

1. A toothbrush comprising:

a head portion provided on a tip end side in a long axis direction and having a bristle tufting surface;

a grip portion disposed on a rear end side from the head portion;

a neck portion disposed between the bristle tufting surface and the grip portion; and an anisotropic deformation portion provided on a rear end side from the bristle tufting surface, in which a bending strength in a first direction orthogonal to the bristle tufting surface is smaller than a bending strength in a second direction orthogonal to the long axis direction and the first direction, wherein the anisotropic deformation portion includes an elastic deformation portion that connects a first region on the tip end side of the anisotropic deformation portion and a second region on the rear end side of the anisotropic deformation portion and is elastically deformable in the first direction and the second direction, any bending load when the head portion is displaced in the first direction with a reference displacement amount of 10 mm, 20 mm, or 30 mm in a state where the grip portion is supported is lower than a bending load when the head portion is displaced in the second direction with a reference displacement amount of 10 mm in a state where the grip portion is supported, wherein the elastic deformation portion includes a first hard portion made of a hard resin and connecting the first region and the second region, and a soft portion made of a soft resin and covering a periphery of the hard portion, wherein the anisotropic deformation portion includes a recessed portion that is open on at least one of a surface on one side and a surface on the other side in the first direction, and provided side by side with the elastic deformation portion in the second direction, two of the elastic deformation portions are provided, wherein the elastic deformation portions are provided on both sides in the second direction with the recessed portion interposed therebetween, and wherein the first hard portion includes a first portion whose thickness in the first direction is thinner at the center side than at both ends in the long axis direction on one side and the other side of the first direction, respectively, and a second portion connecting the center sides of the first portion.

2. The toothbrush according to claim 1, wherein a difference between the bending load when the head portion is displaced in the first direction with the reference displacement amount in a state where the grip portion is supported, and the bending load when the head portion is displaced in the second direction with the reference displacement amount is 5.0 N or more in all of the reference displacement amounts of 10 mm, 20 mm, and 30 mm in a state where the grip portion is supported.

3. The toothbrush according to claim 1, wherein a ratio of the bending load when the head portion is displaced in the second direction with the reference displacement amount in a state where the grip portion is supported to the bending load when the head portion is displaced in the first direction with the reference displacement amount in a state where the grip portion is supported is 5.0 or more in all of the reference displacement amounts of 10 mm, 20 mm, and 30 mm.

4. The toothbrush according to claim 1, wherein any difference between the bending load when the head portion is displaced in the first direction with the reference displacement amount of 10 mm or 20 mm in a state where the grip portion is supported, and the bending load when the head portion is displaced in the second direction with the reference displacement amount of 10 mm is 4.0 N or more in a state where the grip portion is supported.

5. The toothbrush according to claim 1, wherein any ratio of the bending load when the head portion is displaced in the second direction with the reference displacement amount of 10 mm in a state where the grip portion is supported to the bending load when the head portion is displaced in the first direction with the reference displacement amount of 10 mm or 20 mm in a state where the grip portion is supported is 2.0 or more.

6. The toothbrush according to claim 1, wherein the bending load when the head portion is displaced in the second direction with the reference displacement amount is 5.0 N or more in all of the reference displacement amounts of 10 mm, 20 mm, and 30 mm, and the bending load when the head portion is displaced in the first direction with the reference displacement amount is 3.0 N or less in all of the reference displacement amounts of 10 mm, 20 mm, and 30 mm.

7. The toothbrush according to claim 1, wherein the recessed portion includes a through-hole that penetrates the anisotropic deformation portion in the first direction.

8. The toothbrush according to claim 1, wherein, in a cross section orthogonal to the long axis direction of the anisotropic deformation portion, an occupancy rate of a cross-sectional area of a space of the cavity or the recessed portion to a maximum cross-sectional area of the anisotropic deformation portion is 20% or more and 60% or less.

9. The toothbrush according to claim 1, wherein the elastic deformation portion includes a second hard portion is provided that is disposed in the cavity or the recessed portion, connects the first region and the second region, and is made of the hard resin, and at least a portion of the second hard portion overlaps with the first hard portion in the second direction, and a bending strength of the second hard portion in the first direction is smaller than a bending strength of the second hard portion in the second direction.

10. The toothbrush according to claim 9, wherein the second hard portion is disposed with a gap from the elastic deformation portion, and snaps and buckles when an external force exceeding a threshold value is applied to the head portion toward a back side which is a side opposite to the bristle tufting surface in the first direction.

11. The toothbrush according to claim 10, wherein the second hard portion has a protrusion shape toward the back side when the external force in the first direction is equal to or less than the threshold value, and is reversed in a protrusion shape toward the bristle tufting surface side when the external force in the first direction exceeds the threshold value, and an apex of the protrusion shape is located in the recessed portion both when the external force is equal to or less than the threshold value and when the external force exceeds the threshold value.

12. The toothbrush according to claim 10, wherein the second hard portion has a protrusion shape toward the back side when the external force in the first direction is equal to or less than the threshold value, and is reversed in a protrusion shape toward the bristle tufting surface side when the external force in the first direction exceeds the threshold value, and wherein the second hard portion includes a groove portion extending in the second direction on at least one of the bristle tufting surface side and the back side in a region including an apex of the protrusion shape.

13. The toothbrush according to claim 1, wherein a length of the anisotropic deformation portion in the long axis direction is 15 mm or more and 30 mm or less.

* * * * *